US008981888B2

(12) United States Patent
Suzuki et al.

(10) Patent No.: US 8,981,888 B2
(45) Date of Patent: Mar. 17, 2015

(54) MAGNETIC BODY

(75) Inventors: Kenichi Suzuki, Tokyo (JP); Yoshinori Fujikawa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/997,788

(22) PCT Filed: Dec. 19, 2011

(86) PCT No.: PCT/JP2011/079401

§ 371 (c)(1),
(2), (4) Date: Jun. 25, 2013

(87) PCT Pub. No.: WO2012/090765

PCT Pub. Date: Jul. 5, 2012

(65) Prior Publication Data

US 2013/0271249 A1 Oct. 17, 2013

(30) Foreign Application Priority Data

Dec. 27, 2010 (JP) ..... 2010-290821

(51) Int. Cl.

| | |
|---|---|
| ***H01F 7/02*** | (2006.01) |
| ***B22F 3/10*** | (2006.01) |
| ***B22F 9/02*** | (2006.01) |
| ***C22C 33/02*** | (2006.01) |
| ***C22C 38/00*** | (2006.01) |
| ***C22C 38/06*** | (2006.01) |
| ***C22C 38/10*** | (2006.01) |
| ***C22C 38/12*** | (2006.01) |
| ***C22C 38/16*** | (2006.01) |
| ***H01F 1/057*** | (2006.01) |
| ***H01F 1/03*** | (2006.01) |

(52) U.S. Cl.

CPC ..... *H01F 7/0226* (2013.01); *B22F 3/10* (2013.01); *B22F 9/023* (2013.01); *C22C 33/0278* (2013.01); *C22C 38/002* (2013.01); *C22C 38/005* (2013.01); *C22C 38/06* (2013.01); *C22C 38/10* (2013.01); *C22C 38/12* (2013.01); *C22C 38/16* (2013.01); *H01F 1/0575* (2013.01); *H01F 1/03* (2013.01)

USPC ..... 335/302; 427/127

(58) Field of Classification Search

USPC ..... 335/296, 302; 427/137; 148/300–302, 148/400

See application file for complete search history.

(56) References Cited

U.S. PATENT DOCUMENTS

| | | | | |
|---|---|---|---|---|
| 7,199,690 | B2 * | 4/2007 | Hidaka et al. | 335/302 |
| 2011/0210810 | A1 * | 9/2011 | Miyata et al. | 335/302 |
| 2012/0161910 | A1 * | 6/2012 | Nagaoka et al. | 335/302 |
| 2012/0280775 | A1 * | 11/2012 | Nagata et al. | 335/302 |

FOREIGN PATENT DOCUMENTS

| | | | |
|---|---|---|---|
| JP | 10-64710 | A | 3/1998 |
| JP | 2010-034522 | A | 2/2010 |

* cited by examiner

*Primary Examiner* — Bernard Rojas

(74) *Attorney, Agent, or Firm* — Drinker Biddle & Reath LLP

(57) ABSTRACT

A magnetic body which can reversibly change its magnetic force with a small external magnetic field while having a high residual magnetic flux density is provided. The magnetic body of the present invention has a residual magnetic flux density Br of at least 11 kG and a coercive force HcJ of 5 kOe or less, while an external magnetic field required for the residual magnetic flux density Br to become 0 is 1.10 HcJ or less.

6 Claims, 15 Drawing Sheets

(a)

(b)

(a)

(b)

(a)

(b)

(a)

(b)

| Analysis location | O | Al | Fe | Co | Cu | Ga | Nb | Nd | Total (atom %) | |
|---|---|---|---|---|---|---|---|---|---|---|
| LG20000 ; 0.000 μm | 0.7 | 0.1 | 82.2 | 5 | 0.5 | 0.5 | 0 | 10.9 | 100 | |
| LG20001 ; 0.027 μm | 1.2 | 0 | 81.7 | 4.9 | 0.6 | 0.5 | 0 | 11.1 | 100 | |
| LG20002 ; 0.054 μm | 1.3 | 0.1 | 81.2 | 4.7 | 0.5 | 0.6 | 0 | 11.5 | 100 | |
| LG20003 ; 0.081 μm | 3.1 | 0 | 79.4 | 4.8 | 0.5 | 0.5 | 0 | 11.7 | 100 | |
| LG20004 ; 0.108 μm | 2.2 | 0.1 | 80.1 | 5 | 0.4 | 0.5 | 0 | 11.7 | 100 | |
| LG20005 ; 0.135 μm | 2 | 0.2 | 80.8 | 4.7 | 0.5 | 0.7 | 0 | 11.2 | 100 | grain boundary |
| LG20006 ; 0.162 μm | 1.7 | 0.1 | 81.2 | 4.7 | 0.5 | 0.5 | 0 | 11.3 | 100 | |
| LG20007 ; 0.188 μm | 2.5 | 0.2 | 80.7 | 4.8 | 0.5 | 0.4 | 0 | 11 | 100 | |
| LG20008 ; 0.215 μm | 1.4 | 0 | 82 | 4.8 | 0.5 | 0.6 | 0 | 10.8 | 100 | |
| LG20009 ; 0.242 μm | 1.2 | 0.1 | 81.6 | 5.1 | 0.4 | 0.5 | 0 | 11.1 | 100 | |
| LG20010 ; 0.269 μm | 1.8 | 0 | 81.2 | 4.9 | 0.6 | 0.7 | 0 | 10.8 | 100 | |
| LG20011 ; 0.296 μm | 1.3 | 0.1 | 82 | 4.7 | 0.5 | 0.6 | 0 | 10.7 | 100 | |
| LG20012 ; 0.323 μm | 1.7 | 0.1 | 81.8 | 4.8 | 0.5 | 0.5 | 0 | 10.7 | 100 | |
| LG20013 ; 0.350 μm | 1.3 | 0.1 | 82.1 | 4.8 | 0.5 | 0.5 | 0 | 10.7 | 100 | |
| LG20014 ; 0.377 μm | 1.8 | 0.2 | 81.2 | 4.9 | 0.4 | 0.5 | 0 | 10.9 | 100 | |
| LG20015 ; 0.404 μm | 2 | 0.1 | 81.2 | 4.7 | 0.5 | 0.5 | 0 | 11 | 100 | |
| LG20016 ; 0.431 μm | 0.9 | 0 | 82.4 | 4.8 | 0.5 | 0.5 | 0 | 10.8 | 100 | |
| LG20017 ; 0.458 μm | 2.5 | 0.1 | 80.5 | 4.9 | 0.4 | 0.5 | 0 | 11 | 100 | |
| LG20018 ; 0.485 μm | 1.5 | 0.1 | 81.2 | 4.9 | 0.5 | 0.6 | 0 | 11.1 | 100 | |
| LG20019 ; 0.511 μm | 1.4 | 0.1 | 81.7 | 4.7 | 0.6 | 0.5 | 0 | 11.1 | 100 | |
| LG20020 ; 0.538 μm | 2.1 | 0.2 | 81 | 5 | 0.5 | 0.5 | 0 | 10.8 | 100 | |
| LG20021 ; 0.565 μm | 2 | 0 | 81.4 | 4.8 | 0.5 | 0.5 | 0 | 10.8 | 100 | |
| LG20022 ; 0.592 μm | 0.9 | 0.3 | 82.2 | 4.7 | 0.5 | 0.5 | 0 | 11 | 100 | |
| LG20023 ; 0.619 μm | 1.7 | 0.2 | 81 | 5 | 0.4 | 0.6 | 0 | 11.1 | 100 | |
| LG20024 ; 0.646 μm | 0.7 | 0 | 82 | 4.9 | 0.5 | 0.6 | 0 | 11.2 | 100 | |
| LG20025 ; 0.673 μm | 1.9 | 0.2 | 80.4 | 5.2 | 0.5 | 0.5 | 0 | 11.3 | 100 | grain boundary |
| LG20026 ; 0.700 μm | 1.9 | 0 | 81.3 | 4.8 | 0.4 | 0.5 | 0 | 11.1 | 100 | |
| LG20027 ; 0.727 μm | 1.9 | 0.2 | 81.6 | 4.3 | 0.4 | 0.4 | 0 | 11.2 | 100 | |
| LG20028 ; 0.754 μm | 3 | 0 | 80 | 4.9 | 0.5 | 0.6 | 0 | 11 | 100 | |
| LG20029 ; 0.781 μm | 1.7 | 0.2 | 81.2 | 5 | 0.4 | 0.5 | 0 | 10.9 | 100 | |

(a)

(b)

| Analysis location | O | Al | Fe | Co | Cu | Ga | Nb | Nd | Total (atom %) | |
|---|---|---|---|---|---|---|---|---|---|---|
| LG50000 ; 0.000 μm | 4.4 | 0.4 | 78.3 | 5.1 | 0.0 | 0.6 | 0.0 | 11.3 | 100 | |
| LG50001 ; 0.021 μm | 6.8 | 0.2 | 76.6 | 4.9 | 0.0 | 0.5 | 0.0 | 10.9 | 100 | |
| LG50002 ; 0.042 μm | 7.5 | 0.3 | 70.9 | 4.6 | 0.3 | 1.4 | 0.0 | 15.0 | 100 | grain boundary |
| LG50003 ; 0.062 μm | 5.0 | 0.2 | 77.9 | 4.7 | 0.0 | 0.3 | 0.0 | 11.9 | 100 | |
| LG50004 ; 0.083 μm | 5.1 | 0.1 | 78.1 | 4.6 | 0.0 | 0.4 | 0.0 | 11.7 | 100 | |
| LG50005 ; 0.104 μm | 6.1 | 0.0 | 76.9 | 4.5 | 0.1 | 0.4 | 0.0 | 11.9 | 100 | |
| LG50006 ; 0.125 μm | 7.6 | 0.1 | 75.6 | 4.6 | 0.0 | 0.4 | 0.0 | 11.7 | 100 | |
| LG50007 ; 0.146 μm | 6.6 | 0.0 | 76.3 | 4.8 | 0.0 | 0.6 | 0.0 | 11.8 | 100 | |
| LG50008 ; 0.167 μm | 6.3 | 0.3 | 76.6 | 4.6 | 0.1 | 0.5 | 0.0 | 11.6 | 100 | |
| LG50009 ; 0.187 μm | 6.9 | 0.0 | 75.9 | 4.7 | 0.0 | 0.6 | 0.0 | 11.8 | 100 | |
| LG50010 ; 0.208 μm | 6.8 | 0.1 | 76.3 | 4.5 | 0.0 | 0.5 | 0.0 | 11.7 | 100 | |
| LG50011 ; 0.229 μm | 6.6 | 0.1 | 76.5 | 5.2 | 0.0 | 0.6 | 0.0 | 10.9 | 100 | |
| LG50012 ; 0.250 μm | 5.9 | 0.1 | 77.3 | 4.6 | 0.1 | 0.5 | 0.0 | 11.6 | 100 | |
| LG50013 ; 0.271 μm | 5.9 | 0.2 | 76.9 | 5.0 | 0.1 | 0.5 | 0.0 | 11.5 | 100 | |
| LG50014 ; 0.292 μm | 7.4 | 0.2 | 76.1 | 4.8 | 0.1 | 0.6 | 0.0 | 10.9 | 100 | |
| LG50015 ; 0.312 μm | 5.2 | 0.1 | 78.8 | 4.7 | 0.0 | 0.4 | 0.0 | 10.9 | 100 | |
| LG50016 ; 0.333 μm | 5.9 | 0.3 | 76.5 | 5.2 | 0.1 | 0.5 | 0.0 | 11.6 | 100 | |
| LG50017 ; 0.354 μm | 8.3 | 0.1 | 75.4 | 4.6 | 0.0 | 0.6 | 0.0 | 11.0 | 100 | |
| LG50018 ; 0.375 μm | 6.7 | 0.3 | 75.7 | 4.6 | 0.1 | 0.5 | 0.0 | 12.0 | 100 | |
| LG50019 ; 0.396 μm | 7.7 | 0.0 | 75.6 | 4.8 | 0.1 | 0.4 | 0.0 | 11.4 | 100 | |
| LG50020 ; 0.417 μm | 9.1 | 0.3 | 74.1 | 4.6 | 0.0 | 0.5 | 0.0 | 11.3 | 100 | |
| LG50021 ; 0.437 μm | 8.7 | 0.1 | 74.0 | 4.7 | 0.1 | 0.6 | 0.0 | 11.8 | 100 | |
| LG50022 ; 0.458 μm | 6.9 | 0.2 | 75.9 | 4.8 | 0.2 | 0.5 | 0.0 | 11.6 | 100 | |
| LG50023 ; 0.479 μm | 7.4 | 0.0 | 75.6 | 4.9 | 0.0 | 0.5 | 0.0 | 11.7 | 100 | |
| LG50024 ; 0.500 μm | 8.2 | 0.0 | 74.4 | 4.7 | 0.1 | 0.6 | 0.0 | 12.0 | 100 | |
| LG50025 ; 0.521 μm | 11.0 | 0.1 | 72.4 | 4.4 | 0.0 | 0.4 | 0.0 | 11.6 | 100 | |
| LG50026 ; 0.541 μm | 10.0 | 0.1 | 73.2 | 4.6 | 0.1 | 0.7 | 0.0 | 11.4 | 100 | |
| LG50027 ; 0.562 μm | 12.5 | 0.2 | 62.1 | 4.9 | 0.6 | 2.9 | 0.0 | 16.7 | 100 | grain boundary |
| LG50028 ; 0.583 μm | 12.0 | 0.2 | 70.9 | 4.6 | 0.1 | 0.7 | 0.0 | 11.5 | 100 | |
| LG50029 ; 0.604 μm | 12.5 | 0.2 | 70.7 | 4.6 | 0.0 | 1.0 | 0.0 | 11.0 | 100 | |

(a)

(b)

(c)

| Analysis location | | Content (atom %) | | | | | | | | |
|---|---|---|---|---|---|---|---|---|---|---|
| | | O | Al | Fe | Co | Cu | Ga | Nb | Nd | Total |
| Grain boundary | 1 | 2.0 | 0.2 | 80.5 | 5.0 | 0.5 | 0.7 | 0.0 | 11.1 | 100 |
| | 2 | 2.1 | 0.3 | 77.6 | 5.7 | 1.3 | 1.0 | 0.0 | 12.1 | 100 |
| | 3 | 0.5 | 0.1 | 81.8 | 4.9 | 0.6 | 0.6 | 0.0 | 11.5 | 100 |
| | 4 | 1.4 | 0.2 | 81.9 | 5.2 | 0.4 | 0.4 | 0.0 | 10.5 | 100 |
| | 5 | 1.6 | 0.1 | 78.5 | 5.2 | 1.0 | 0.7 | 0.0 | 12.9 | 100 |
| | 6 | 2.4 | 0.2 | 78.2 | 5.2 | 1.3 | 0.9 | 0.0 | 12.0 | 100 |
| Main-phase particle | 7 | 1.9 | 0.2 | 81.3 | 5.1 | 0.5 | 0.6 | 0.0 | 10.6 | 100 |
| | 8 | 1.2 | 0.2 | 82.3 | 4.7 | 0.5 | 0.5 | 0.0 | 10.7 | 100 |
| | 9 | 2.2 | 0.3 | 81.4 | 4.8 | 0.4 | 0.5 | 0.0 | 10.4 | 100 |
| | 10 | 1.7 | 0.0 | 81.7 | 4.9 | 0.5 | 0.5 | 0.0 | 10.7 | 100 |
| Grain boundary triple junction | 11 | 3.1 | 0.3 | 9.0 | 4.8 | 28.7 | 5.3 | 0.0 | 48.8 | 100 |
| | 12 | 2.4 | 0.1 | 80.3 | 4.9 | 0.6 | 0.6 | 0.0 | 11.0 | 100 |
| | 13 | 4.2 | 0.3 | 30.4 | 3.9 | 23.4 | 3.0 | 0.0 | 34.8 | 100 |
| | 14 | 3.3 | 0.1 | 75.3 | 5.2 | 2.2 | 0.8 | 0.0 | 13.1 | 100 |
| Main-phase particle | 15 | 1.2 | 0.2 | 82.1 | 5.0 | 0.4 | 0.5 | 0.0 | 10.5 | 100 |
| | 16 | 1.8 | 0.0 | 81.8 | 4.8 | 0.5 | 0.5 | 0.0 | 10.6 | 100 |
| Grain boundary | 17 | 4.9 | 0.2 | 76.7 | 5.2 | 0.6 | 1.0 | 0.0 | 11.4 | 100 |
| | 18 | 7.2 | 0.0 | 73.5 | 4.8 | 1.0 | 1.3 | 0.0 | 12.2 | 100 |
| | 19 | 2.7 | 0.0 | 78.4 | 5.4 | 0.8 | 0.7 | 0.0 | 11.9 | 100 |
| | 20 | 5.0 | 0.4 | 76.9 | 5.1 | 0.5 | 0.7 | 0.0 | 11.4 | 100 |
| Main-phase particle | 21 | 3.4 | 0.3 | 79.8 | 4.8 | 0.4 | 0.8 | 0.0 | 10.5 | 100 |
| | 22 | 4.5 | 0.1 | 78.2 | 4.8 | 0.6 | 0.8 | 0.0 | 11.0 | 100 |
| | 23 | 2.2 | 0.1 | 80.3 | 4.9 | 0.5 | 0.6 | 0.0 | 11.5 | 100 |
| | 24 | 3.1 | 0.1 | 80.2 | 4.9 | 0.5 | 0.4 | 0.0 | 10.8 | 100 |
| | 25 | 4.4 | 0.0 | 79.2 | 4.8 | 0.5 | 0.7 | 0.0 | 10.4 | 100 |
| | 26 | 3.3 | 0.1 | 79.2 | 5.1 | 0.5 | 0.6 | 0.0 | 11.1 | 100 |
| Grain boundary triple junction | 27 | 10.1 | 0.1 | 15.2 | 4.0 | 22.1 | 2.9 | 0.0 | 45.6 | 100 |
| | 28 | 3.8 | 0.0 | 63.0 | 4.7 | 8.7 | 1.6 | 0.0 | 18.1 | 100 |
| | 29 | 5.4 | 0.3 | 46.2 | 4.6 | 14.4 | 2.6 | 0.0 | 26.6 | 100 |

(a)

(b)

(c)

| Analysis location | | Content (atom %) | | | | | | | | |
|---|---|---|---|---|---|---|---|---|---|---|
| | | O | Al | Fe | Co | Cu | Ga | Nb | Nd | Total |
| Grain boundary | 76 | 7.7 | 0.0 | 72.6 | 4.8 | 0.3 | 0.9 | 0 | 13.7 | 100 |
| | 77 | 6.3 | 0.2 | 76 | 4.4 | 0.2 | 0.6 | 0 | 12.3 | 100 |
| | 78 | 5.9 | 0.0 | 75.7 | 4.7 | 0.1 | 0.9 | 0 | 12.7 | 100 |
| | 79 | 9.1 | 0.3 | 72.3 | 5 | 0.2 | 0.8 | 0 | 12.3 | 100 |
| Main-phase particle | 80 | 6.9 | 0.0 | 76.8 | 4.4 | 0.1 | 0.6 | 0 | 11.3 | 100 |
| | 81 | 7.1 | 0.0 | 76.4 | 4.6 | 0 | 0.5 | 0 | 11.3 | 100 |
| | 82 | 5.2 | 0.4 | 77.8 | 4.6 | 0.1 | 0.4 | 0 | 11.6 | 100 |
| | 83 | 6.3 | 0.0 | 77.4 | 4.7 | 0 | 0.4 | 0 | 11.2 | 100 |
| | 84 | 6.4 | 0.2 | 76.7 | 4.6 | 0 | 0.6 | 0 | 11.5 | 100 |
| | 85 | 7.2 | 0.2 | 75.8 | 4.9 | 0.1 | 0.5 | 0 | 11.4 | 100 |
| | 86 | 7.0 | 0.3 | 76.5 | 4.7 | 0 | 0.4 | 0 | 11 | 100 |
| | 87 | 8.2 | 0.0 | 75.2 | 4.9 | 0.1 | 0.5 | 0 | 11.1 | 100 |
| Grain boundary triple junction | 88 | 7.4 | 0.0 | 58.1 | 6.2 | 0.7 | 4.3 | 0 | 23.2 | 100 |
| | 89 | 6.7 | 0.1 | 55.7 | 7.1 | 1.2 | 5.2 | 0 | 24 | 100 |
| | 90 | 9.7 | 0.2 | 57.8 | 6.7 | 0.5 | 1.2 | 0 | 23.9 | 100 |
| | 91 | 12.2 | 0.3 | 67.2 | 4.2 | 0.2 | 1.1 | 0 | 14.7 | 100 |
| | 92 | 8.3 | 0.4 | 48.5 | 7.2 | 1.4 | 6.2 | 0 | 28 | 100 |
| Grain boundary | 93 | 8.5 | 0.1 | 72.2 | 4.6 | 0.2 | 1.2 | 0.0 | 13.1 | 100 |
| | 94 | 10.2 | 0.1 | 72.9 | 4.5 | 0.2 | 0.7 | 0.0 | 11.4 | 100 |
| | 95 | 7.2 | 0.0 | 76.2 | 4.8 | 0.0 | 0.6 | 0.0 | 11.1 | 100 |
| Grain boundary triple junction | 96 | 14.9 | 0.5 | 41.3 | 7.8 | 0.3 | 0.6 | 0.0 | 34.6 | 100 |
| | 97 | 22.6 | 0.4 | 23.0 | 11.7 | 1.2 | 0.8 | 0.0 | 40.3 | 100 |
| | 98 | 7.3 | 0.1 | 68.6 | 6.4 | 0.2 | 0.7 | 0.0 | 16.6 | 100 |
| | 99 | 6.0 | 0.2 | 62.0 | 7.9 | 0.4 | 0.7 | 0.0 | 22.8 | 100 |
| | 100 | 6.6 | 0.1 | 83.7 | 4.3 | 0.0 | 0.3 | 0.0 | 4.9 | 100 |
| | 101 | 10.2 | 0.0 | 66.9 | 4.9 | 0.3 | 1.2 | 0.0 | 16.4 | 100 |
| Main-phase particle | 102 | 5.9 | 0.3 | 77.6 | 5.0 | 0.1 | 0.6 | 0.0 | 10.7 | 100 |
| | 103 | 9.5 | 0.2 | 74.6 | 4.4 | 0.0 | 0.4 | 0.0 | 10.8 | 100 |
| | 104 | 8.1 | 0.0 | 75.3 | 4.8 | 0.0 | 0.4 | 0.0 | 11.4 | 100 |
| | 105 | 6.5 | 0.3 | 76.3 | 4.7 | 0.0 | 0.5 | 0.0 | 11.7 | 100 |
| | 106 | 6.3 | 0.2 | 76.6 | 4.9 | 0.0 | 0.5 | 0.0 | 11.5 | 100 |
| | 107 | 8.6 | 0.1 | 74.6 | 4.7 | 0.1 | 0.4 | 0.0 | 11.5 | 100 |
| | 108 | 9.8 | 0.6 | 71.9 | 4.7 | 0.1 | 0.5 | 0.0 | 12.4 | 100 |
| | 109 | 10.2 | 0.3 | 72.7 | 4.4 | 0.0 | 0.6 | 0.0 | 11.9 | 100 |
| | 110 | 4.5 | 0.0 | 78.8 | 4.4 | 0.0 | 0.4 | 0.0 | 11.8 | 100 |
| | 111 | 6.8 | 0.1 | 76.5 | 4.6 | 0.0 | 0.5 | 0.0 | 11.5 | 100 |

MAGNETIC BODY

TECHNICAL FIELD

The present invention relates to a magnetic body.

BACKGROUND ART

Permanent magnet motors have conventionally been used as power units for home appliances such as wash machines and clothes dryers, hybrid cars, electric trains, elevators, and the like. When driving a permanent magnet motor at variable speeds, however, the induced voltage therein increases in proportion to the rotational speed, since the permanent magnet has a fixed magnetic flux. The driving becomes hard at such a high rotational speed that the induced voltage is at the power-supply voltage or higher. Therefore, in a middle/high speed range or under light load, it has been necessary for the conventional permanent magnet motors to perform flux-weakening control for canceling out the magnetic flux of the permanent magnet with a magnetic flux caused by an armature current, which lowers the efficiency of the motors.

For solving such problems, variable-magnetic-flux motors using a magnet (variable-magnetic-force magnet) whose magnetic force reversibly changes under action of an external magnetic field have been developed in recent years. By lowering the magnetic force of the variable-magnetic-force magnet in the middle/high speed range or under light load, the variable-magnetic-flux motors can inhibit their efficiency from decreasing as in the conventional motors.

CITATION LIST

Patent Literature

Patent Literature 1: Japanese Patent Application Laid-Open No. 2010-34522

SUMMARY OF INVENTION

Technical Problem

The conventional variable-magnetic-flux motors use a combination of a stationary magnet with a fixed magnetic force such as an Nd—Fe—B-based rare-earth magnet (e.g., $Nd_2Fe_{14}B$) and a variable-magnetic-force magnet such as $Sm_2Co_{17}$, for example. The residual flux density Br is about 13 kG in $Nd_2Fe_{14}B$, which is the stationary magnet, and about 10 kG in $Sm_2Co_{17}$, which is the variable-magnetic-force magnet. Such a difference in magnetic force between the stationary and variable-magnetic-force magnets may cause the motors to lower their output and efficiency.

As a method for improving the output and efficiency of the variable-magnetic-force motor, a magnetic flux on a par with that of the stationary magnet may be taken out from the variable-magnetic-force magnet. However, the saturation magnetization Is is about 12.5 kG in $Sm_2Co_{17}$ and about 16.0 kG in $Nd_2Fe_{14}B$, which makes it difficult for $Sm_2Co_{17}$ to achieve the Br on a par with that of $Nd_2Fe_{14}B$.

As another method for improving the output and efficiency of the variable-magnetic-force motor, the Nd—Fe—B-based rare-earth magnet, which has conventionally been used as the stationary magnet, may be employed as the variable-magnetic-force magnet. However, the Nd—Fe—B-based rare-earth magnet has a magnetization (coercive force) mechanism of a nucleation type, which necessitates an external magnetic field larger than that in the case of $Sm_2Co_{17}$ for changing its magnetic force or reversing the magnetization. As the external magnetic field becomes larger, a greater magnetic magnetization current is necessary, which lowers the efficiency in the motors, while making them hard to be controlled by magnetic circuits. Because of these problems, it is not easy for the Nd—Fe—B-based rare-earth magnet to be put into practical use as the variable-magnetic-force magnet.

Therefore, for practical use as the variable-magnetic-force magnet, it is necessary for the Nd—Fe—B-based rare-earth magnet to achieve a magnetization mechanism of a pinning type as in $Sm_2Co_{17}$ or a single-domain particle type as in ferrite magnets.

In view of such problems of the prior art, it is an object of the present invention to provide a magnetic body which can reversibly change its magnetic force with a small external magnetic field while having a high residual magnetic flux density.

Solution to Problem

For achieving the problems mentioned above, the magnetic body in accordance with the present invention has a residual magnetic flux density Br of at least 11 kG and a coercive force HcJ of 5 kOe or less, while an external magnetic field required for the residual magnetic flux density Br to become 0 is 1.10 HcJ or less.

The magnetic body in accordance with the present invention can reversibly change its magnetic force (magnetic flux density) with a small external magnetic field while having a high residual magnetic flux density and thus is suitable as a variable-magnetic-field magnet for variable-magnetic-flux motors.

Preferably, the magnetic body in accordance with the present invention contains a rare-earth element R, a transition metal element T, and boron B. That is, it is preferred for the magnetic body in accordance with the present invention to have a composition of an R-T-B-based rare-earth magnet. The magnetic body having such a composition makes the effects of the present invention remarkable and does not require Co, which is expensive and unstable in its amount of supply, as in SmCo-based magnets, and thus can lower its cost.

Preferably, the magnetic body in accordance with the present invention has a crystal particle size of 1 μm or less. This makes the effects of the present invention remarkable.

Advantageous Effects of Invention

The present invention can provide a magnetic body which can reversibly change its magnetic force with a small external magnetic field while having a high residual magnetic flux density.

BRIEF DESCRIPTION OF DRAWINGS

FIG. 1*a* is a photograph of a fracture surface of the magnetic body of Example 4 of the present invention taken by a scanning electron microscope (SEM), while FIG. 1*b* is a photograph of a cross section of the magnetic body of Example 4 of the present invention taken by a scanning transmission electron microscope (STEM);

DESCRIPTION OF EMBODIMENTS

In the following, a preferred embodiment of the present invention will be explained in detail with reference to the drawings. However, the present invention is not limited to the following embodiment.

Magnetic Body

Preferably, the magnetic body in accordance with this embodiment contains a rare-earth element R, a transition metal element T, and boron B. The rare-earth element R may be at least one kind selected from the group consisting of La, Ce, Pr, Nd, Pm, Sm, Eu, Gd, Tb, Dy, Ho, Er, Tm, Yb, and Lu. Preferably, the rare-earth element R is at least one kind of Nd and Pr in particular. Examples of the transition metal element T include Fe and Co. While Fe is preferred as the transition metal element T, the magnetic body may contain both elements Fe and Co as T. The magnetic body having the above-mentioned composition remarkably improves its saturation magnetic flux density and residual magnetic flux density. The magnetic body may further contain other elements such as Ca, Ni, Mn, Al, Cu, Nb, Zr, Ti, W, Mo, V, Ga, Zn, Si, and Bi as impurities or additives.

Figure 3:
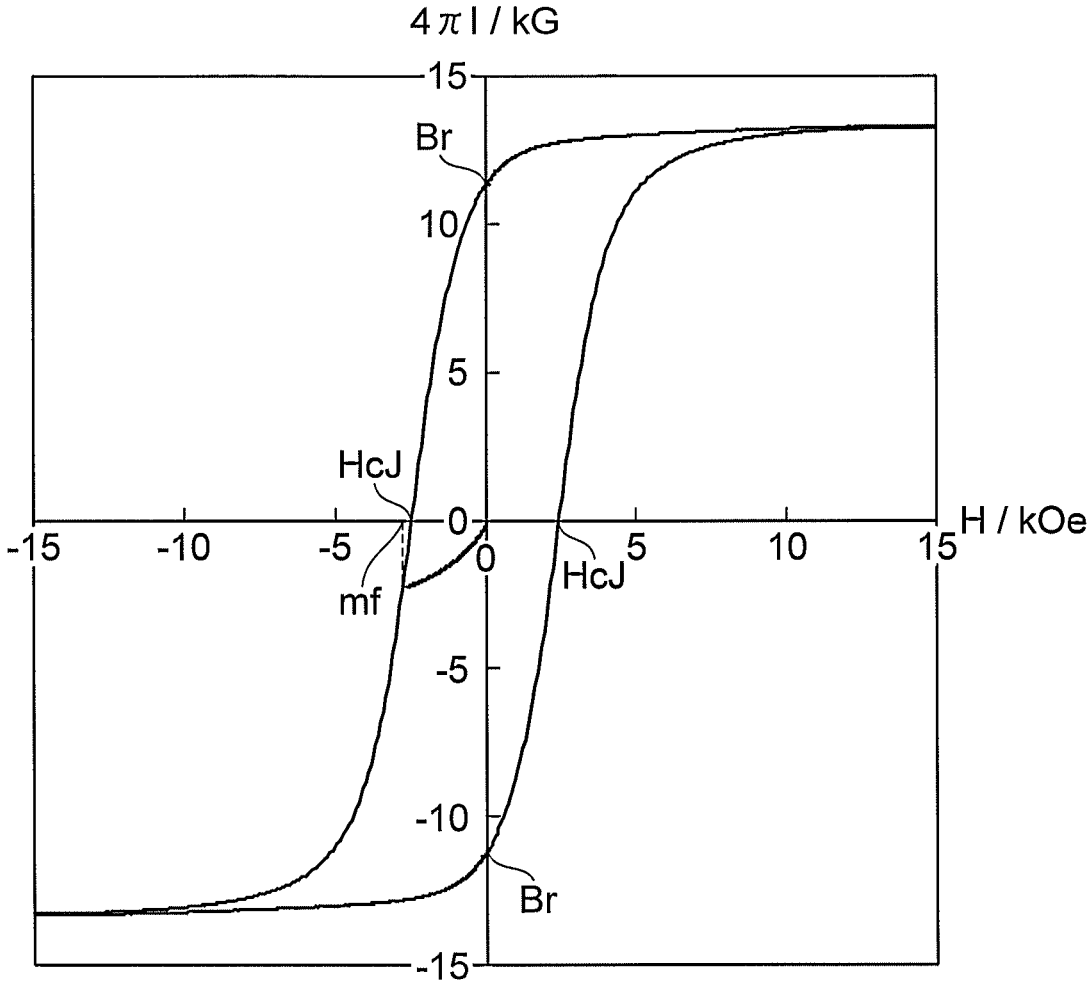
FIG. 3 is a magnetization vs. magnetic field curve of Example 4 of the present invention.

As illustrated in FIG. 3, the magnetic body in accordance with this embodiment has a residual magnetic flux density Br of at least 11 kG (at least 1.1 T). Preferably, the Br of the magnetic body is at least 12.5 kG (at least 1.25 T). The upper limit of Br of the magnetic body is about 14 kG (1.4 T), though not restricted in particular. The Br of the magnetic body in accordance with this embodiment is higher than that (10 kG) of an $Sm_2Co_{17}$ sintered magnet which has conventionally been used as a variable-magnetic-force magnet. Therefore, a variable-magnetic-flux motor using the magnetic body in accordance with this embodiment as a variable-magnetic-force magnet allows the variable-magnetic-force magnet to have a magnetic force on a par with that of a stationary magnet, thereby achieving an output and an efficiency which are higher than those conventionally available.

The magnetic body in accordance with this embodiment has a coercive force HcJ of 5.0 kOe or less (400 A/m or less). Preferably, the HcJ of the magnetic body is 4.0 kOe or less (320 A/m or less). The lower limit of HcJ of the magnetic body is about 1.0 kOe (80 A/m), though not restricted in particular.

The magnitude of external magnetic field required for the Br of the magnetic body in accordance with this embodiment to become 0 is 1.10 HcJ or less. That is, the magnitude of external magnetic field required for the Br of the magnetic body in accordance with this embodiment to become 0 is 110% of HcJ or less. Preferably, the external magnetic field required for the Br of the magnetic body to become 0 is 1.05 HcJ or less. The lower limit of the external magnetic field required for the Br of the magnetic body to become 0 is about 1.00 HcJ. In the following, the (magnitude of) external magnetic field required for the Br of the magnetic body to become 0 will be referred to as "mf" (magnetic field) as the case may be.

In this embodiment, the HcJ is 5 kOe or less, while the magnitude of external magnetic field mf required for the Br of the magnetic body to become 0 is 1.10 HcJ or less, whereby a small external magnetic field enables the magnetic body to reversibly repeat a magnetic force change or magnetization reversal. Even when the magnetic force change or magnetization reversal is repeated, the magnetic body in accordance with this embodiment can maintain the symmetry of its magnetization curve and stably control the magnetic flux density. In a variable-magnetic-flux motor using the magnetic body of this embodiment as a variable-magnetic-force magnet, the external magnetic field required for a magnetic force change or magnetization reversal of the magnetic body is so small that it becomes easier for a magnetic circuit to control the external magnetic field and the magnetic force of the magnetic body, while the magnetization current can be lowered, so as to improve the efficiency of the motor. Therefore, the magnetic body of this embodiment is suitable as a variable-magnetic-force magnet for variable-magnetic-flux motors equipped in home appliances such as wash machines and clothes dryers, hybrid cars, electric trains, elevators, and the like.

Crystals constituting the magnetic body preferably have a particle size of 1 μm or less, more preferably 0.5 μm. When the crystals constituting the magnetic body have a fine particle size, the magnetic body is more likely to have a magnetization mechanism of a pinning type (or single-domain particle type), thus making it easier to exhibit the magnetic characteristic concerning the external magnetic field mf mentioned above. On the other hand, crystals constituting the conventional $Nd_2Fe_{14}B$-based sintered magnet have a particle size of about 5 μm, so that its magnetization mechanism is of the nucleation type.

Preferably, the magnetic body contains Cu.

Magnetic bodies constituted by crystals with fine particle sizes are known to have high coercive force in general. The magnetic bodies having high coercive force require a large external magnetic field for changing their state of magnetization and thus are not suitable as variable-magnetic-force magnets for variable-magnetic-flux motors. By containing an appropriate amount of Cu in a magnetic body, the magnetic body is easier to lower the coercive force while keeping the high residual magnetic flux density and the magnetization mechanism of the pinning type. This can remarkably exhibit the magnetic characteristics concerning the residual magnetic flux density, coercive force, and external magnetic field mentioned above.

Preferably, the magnetic body contains 1.0 to 1.25 mass % of Cu with respect to the total mass thereof. The Br and HcJ tend to decrease as the Cu content increases. The Br and HcJ tend to increase as the Cu content decreases. Preferably, main-phase particles constituting the magnetic body contain 0.5 to 0.6 atom % of Cu with respect to all the elements therein. Here, by the main-phase particles are meant crystal particles made of main components of the magnetic body. Examples of the main components include the rare-earth element R, transition metal element T, and boron B ($Nd_2Fe_{14}B$). The inventors consider that the desirable coercive force is likely to be obtained when the Cu content in the main-phase particles falls within the range mentioned above in the case where the magnetic body has a fine structure constituted by the main-phase particles while its magnetization mechanism is of the pinning type.

The magnetic body may be a powder. The magnetic body may be a pressurized powder body into which a powder is compacted. The magnetic body may be a bond magnet formed by bonding a powder or pressurized powder body of a magnetic body with a resin. The magnetic body may be a sintered body of magnetic particles.

Method of Manufacturing Magnetic Body

First, for manufacturing the magnetic body, a material alloy is cast. As the material alloy, one containing the above-mentioned rare-earth element R, transition metal element T, and B may be used. The material alloy may further contain the elements listed above as additives or impurities when necessary. The chemical composition of the material alloy may be adjusted according to that of the magnetic body to be obtained finally. The material alloy may be either an ingot or powder.

From the material alloy, an alloy powder is formed by HDDR (Hydrogenation-Disproportionation-Desorption-Recombination) processing. The HDDR processing is a process in which hydrogenation, disproportionation, desorption, and recombination of the material alloy are executed sequentially.

The HDDR processing holds the material alloy at a temperature within the range of 500° C. to 1000° C. in an $H_2$ gas atmosphere or a mixed atmosphere of the $H_2$ gas and an inert gas, so as to hydrogenate the material alloy, then dehydrogenates the material alloy at a temperature within the range of 500° C. to 1000° C. until the partial pressure of the $H_2$ gas in the atmosphere becomes 13 Pa or lower, and thereafter cools it. This yields fine crystal particles (Nd-T-B-based magnetic powder) having a composition of an Nd-T-B-based rare-earth magnet.

A Cu powder is added to and mixed with the Nd-T-B-based magnetic powder serving as a main material in an inert gas atmosphere, so as to prepare a material mixture. Preferably, the material mixture contains 1.0 to 1.25 mass % of the Cu powder with respect to the total mass thereof. This makes it easier to yield the magnetic body having the magnetic characteristics mentioned above. As the Cu powder content increases, the resulting magnetic body tends to decrease its Br and HcJ. As the Cu powder content decreases, the resulting magnetic body tends to increase its Br and HcJ.

Heat-treating the material mixture in an inert atmosphere at a temperature within the range of 700° C. to 950° C. completes a powdery magnetic body. This heat treatment thermally diffuses Cu, whereby the Nd-T-B-based magnetic powder lowers its coercive force while keeping the pinning type magnetization mechanism. Here, the Cu-doped Nd-T-B-based magnetic powder hardly grows its grains in the heat treatment at the temperature within the range of 700° C. to 950° C., thereby keeping the fine structure attained before the heat treatment.

For obtaining a sintered magnetic body instead of the powdery magnetic body, the material mixture is molded under pressure in a magnetic field, so as to form a compact. Preferably, the magnetic field applied to the material mixture at the time of molding has a strength of 800 kA/m or higher. Preferably, the pressure applied to the material mixture at the time of molding is about 10 to 500 MPa. As the molding method, any of uniaxial pressing and isostatic pressing such as CIP may be used. Thus obtained compact is fired, so as to form a sintered body. The firing temperature may be on the order of 700° C. to 1200° C. The firing time may be about 0.1 to 100 hr. The firing step may be performed a plurality of times. Preferably, the firing step is performed in a vacuum or an atmosphere of an inert gas such as Ar. The sintered body after firing may be subjected to aging. The sintered body may be processed so as to cut out therefrom a magnetic body having a desirable size. A protective layer may be formed on a surface of the sintered body. Any protective layer can be applied without restrictions in particular as long as it is typically formed as a layer for protecting surfaces of rare-earth magnets. Examples of the protective layer include resin layers formed by painting and vapor deposition polymerization, metal layers formed by plating and gas phase methods, inorganic layers formed by painting and gas phase methods, oxide layers, and chemical conversion layers.

By mixing thus obtained powdery magnetic body with a resin such as a plastic or rubber and curing the resin, a bond magnet may be formed. The bond magnet may also be produced by compacting a powder of the magnetic body into a pressurized powder body, impregnating it with a resin, and then curing the resin.

EXAMPLES

The present invention will now be explained in detail with reference to examples, which do not restrict the same.

Example 4

By centrifugal casting, an ingot of an Nd—Fe—B-based alloy containing elements listed in Table 1 was produced. The contents of elements in the ingot were adjusted to their values listed in Table 1. As can be seen from Table 1, the composition of the ingot substantially equals $Nd_2Fe_{14}B$. Whether or not there were impurity elements inevitably contained in the ingot was analyzed. Table 2 lists the kinds of impurity elements and their contents in the ingot. The composition of the ingot was analyzed by an X-ray fluorescence analysis (XRF).

TABLE 1

| | Nd | Fe | B | Co | Ga | Nb |
|---|---|---|---|---|---|---|
| Atom % | 12.51 | 76.50 | 6.36 | 3.79 | 0.32 | 0.20 |
| Mass % | 28.08 | 66.48 | 1.07 | 3.48 | 0.35 | 0.29 |

TABLE 2

| | Cu | Al | Dy | La | Ce | Pr | Sm | Ni | Mn | Ca | Si | Mg | Sn |
|---|---|---|---|---|---|---|---|---|---|---|---|---|---|
| Atom % | 0.03 | 0.10 | 0.0079 | 0.0000 | 0.0000 | 0.0319 | 0.0009 | 0.0164 | 0.0386 | 0.0016 | 0.0869 | 0.0000 | 0.0000 |
| Mass % | 0.03 | 0.04 | 0.0200 | 0.0000 | 0.0000 | 0.0700 | 0.0020 | 0.0150 | 0.0330 | 0.0010 | 0.0380 | 0.0000 | 0.0000 |

An alloy powder was formed from the ingot by the HDDR processing. The HDDR processing held the ingot at 800° C. in an $H_2$ gas atmosphere, so as to hydrogenate the ingot, then dehydrogenated the ingot at 850° C. until the partial pressure of the $H_2$ gas in the atmosphere became 1 Pa or lower, and thereafter cooled it. The ingot subjected to these steps was pulverized in an Ar gas atmosphere and sieved, so as to yield an Nd—Fe—B-based magnetic powder having a particle size of 212 μm or less.

A Cu powder was added to and mixed with the Nd—Fe—B-based magnetic powder in the Ar gas atmosphere, so as to prepare a material mixture. The content of the Cu powder in the material mixture (hereinafter referred to as "Cu amount") was adjusted to 1.25 mass % with respect to the total mass of the material mixture. The Cu powder had a purity of 99.9 mass % and a particle size of 10 μm or less. A coffee mill was used for the mixing. The mixing time was 1 min. The mixing was performed in the Ar gas atmosphere.

By using a heating furnace, the material mixture was heat-treated at 700° C. in the Ar gas atmosphere, so as to yield the magnetic body of Example 4. In the heat treatment, the material mixture was heated at 700° C. for 4 hr.

Figure 1:
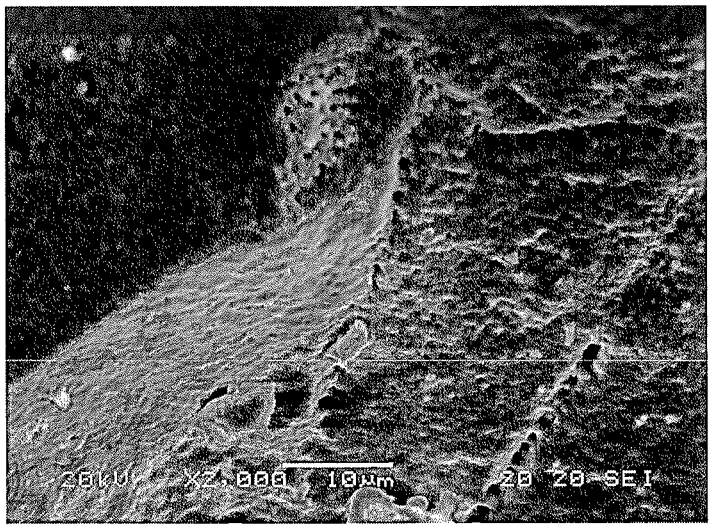
Figure 1:
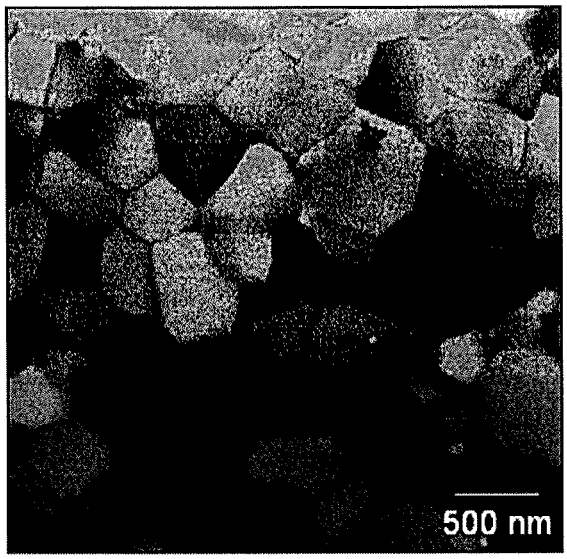

FIG. 1*a* illustrates a photograph of a fracture surface of the magnetic body of Example 4 taken by a scanning electron microscope (SEM). FIG. 1*b* illustrates a photograph of a cross section of the magnetic body of Example 4 taken by a scanning transmission electron microscope (STEM). As illustrated in FIGS. 1*a* and 1*b*, the magnetic body of Example 4 was seen to be an aggregate of fine magnetic particles each having a particle size of 1 μm or less.

Evaluation of Magnetic Characteristics

The magnetic body of Example 4 was pulverized in the Ar gas atmosphere by using a mortar and sieved, so as to yield a powder of the magnetic body having a particle size of 212 μm or less. This powder and paraffin were packed into a case, a magnetic field of 1 T was applied thereto in a state where paraffin was melted, so as to orient the powder of the magnetic body, and a magnetization vs. magnetic field curve was measured by using a vibrating sample magnetometer (VSM), so as to determine magnetic characteristics. The magnetic field applied to the powder of the magnetic body was controlled so as to have a magnitude falling within the range of −25 to 25 kOe. Table 5 lists the results of measurement of the residual magnetic flux density (Br) and coercive force (HcJ) of the magnetic body of Example 4. FIG. 3 illustrates the magnetization vs. magnetic field curve of Example 4.

After measuring the magnetization vs. magnetic field curve, the magnetic body was magnetized until being positively saturated, a reverse magnetic field was applied thereto, and the magnitude of the reverse magnetic field yielding the residual magnetic flux density Br of 0 when the magnetic field was removed, was determined. Table 5 lists the absolute value of the reverse magnetic field yielding the Br of 0 (mf) and its ratio to coercive force HcJ (mf/HcJ).

Examples 1 to 3, 5, and 6 and Comparative Examples 1 to 8

Figure 2:
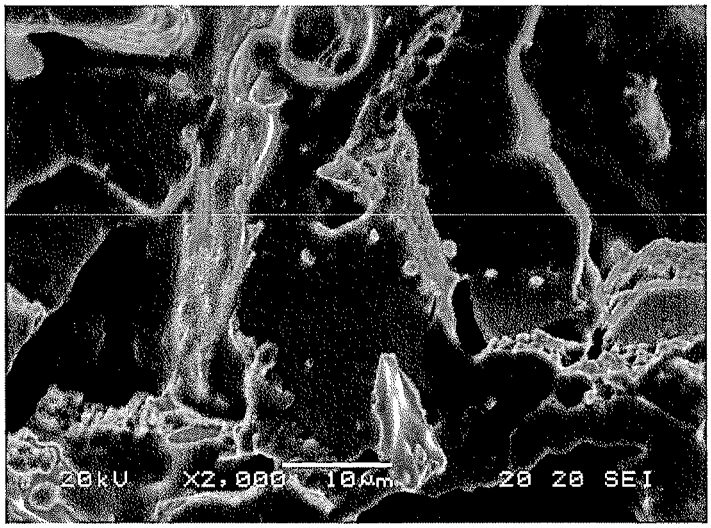
FIG. 2 is a photograph of a fracture surface of the magnetic body of Comparative Example 7 taken by the SEM.

The Cu amounts in the examples and comparative examples were adjusted to their values listed in Table 5. The heat treatment temperatures in the examples and comparative examples were adjusted to their values listed in Table 5. Except for these items, powdery magnetic bodies of the examples and comparative examples were produced as in Example 4. FIG. 2 illustrates a photograph of a fracture surface of the magnetic body of Comparative Example 7 taken by the SEM. In contrast to Example 4, Comparative Example 7 grew grains of magnetic particles without exhibiting a fine organization structure such as that of Example 4.

Figure 4:
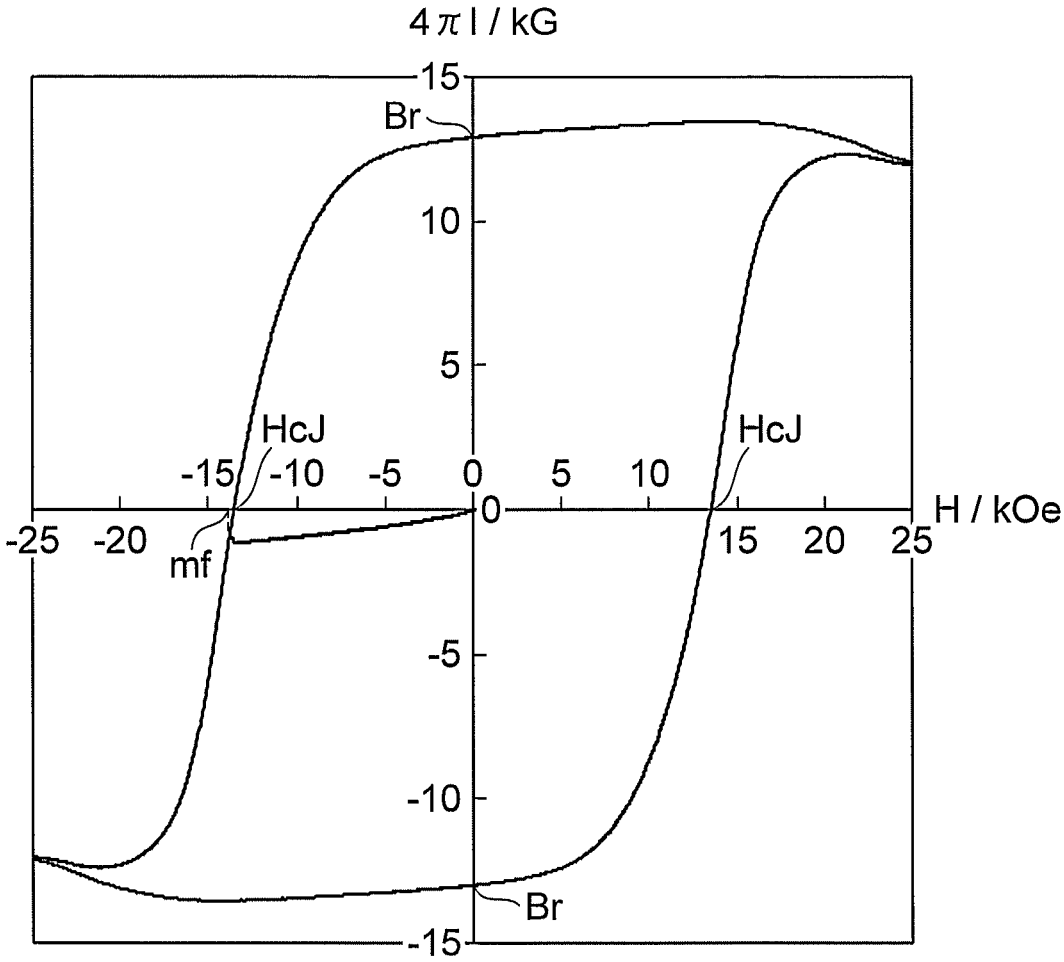
FIG. 4 is a magnetization vs. magnetic field curve of Comparative Example 3.
Figure 5:
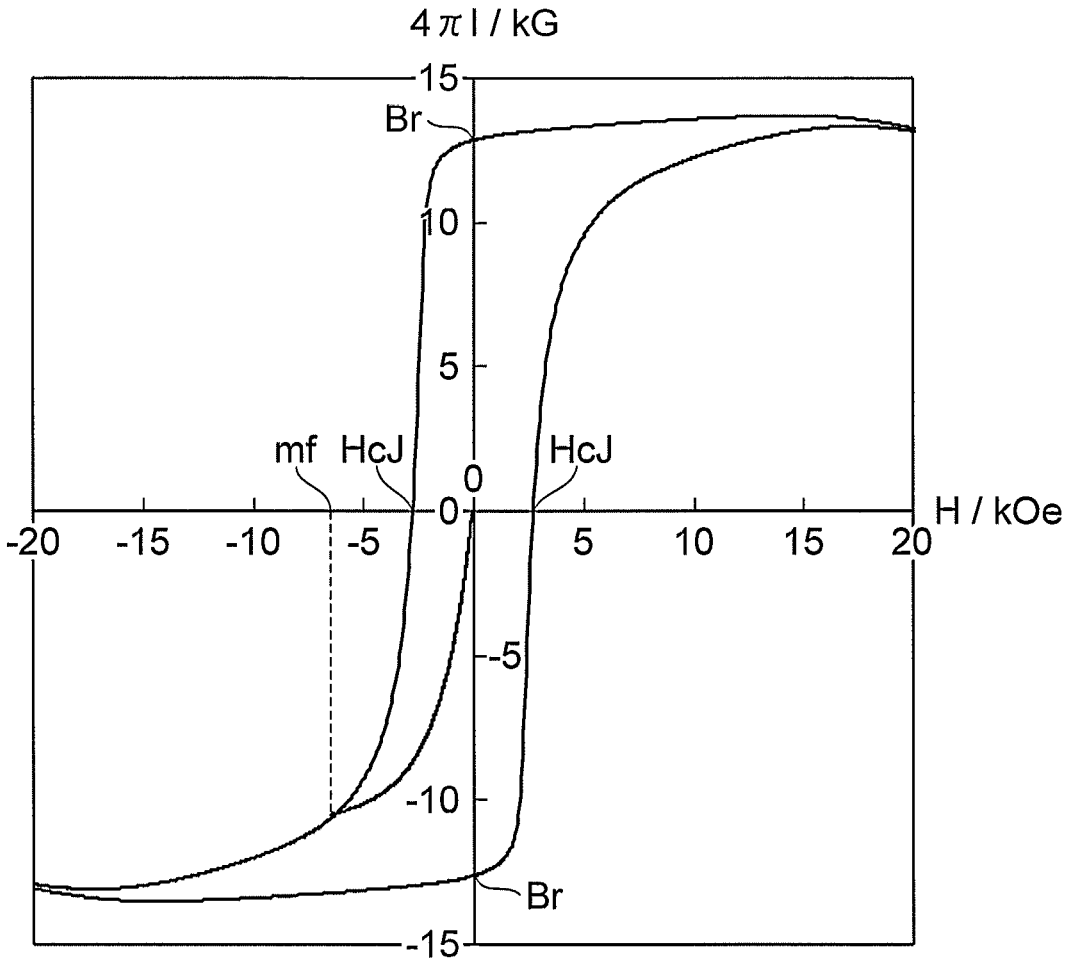
FIG. 5 is a magnetization vs. magnetic field curve of Comparative Example 7.

In each of the examples and comparative examples, the Br, HcJ, mf, and ratio of mf to HcJ were determined as in Example 4. Table 5 lists the results. FIG. 4 illustrates the magnetization vs. magnetic field curve of Comparative Example 3. FIG. 5 illustrates the magnetization vs. magnetic field curve of Comparative Example 7.

SEM-EPMA Analysis

Figure 6:
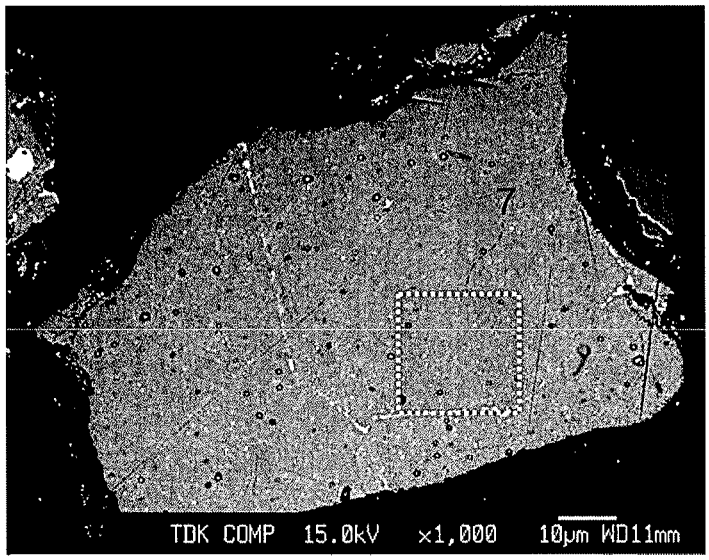
FIGS. 6*a* and 6*b* are backscattered electron images of a part of a cross section of the magnetic body of Example 3 taken by the SEM.
Figure 6:
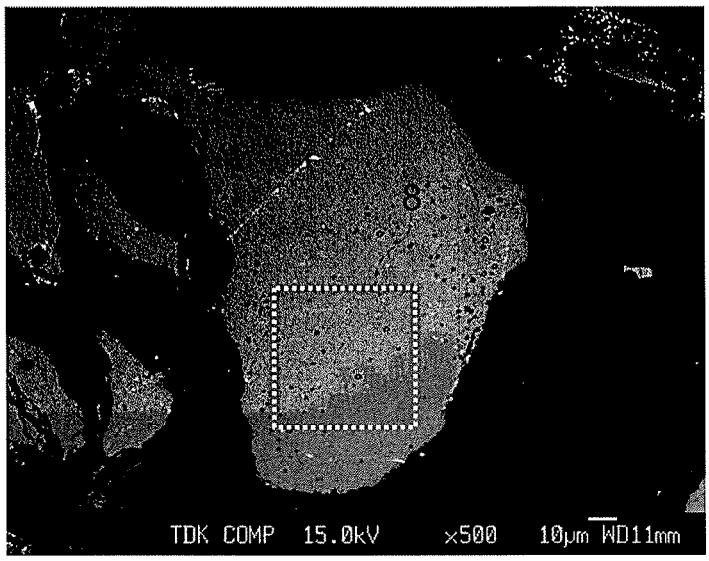
Figure 7:
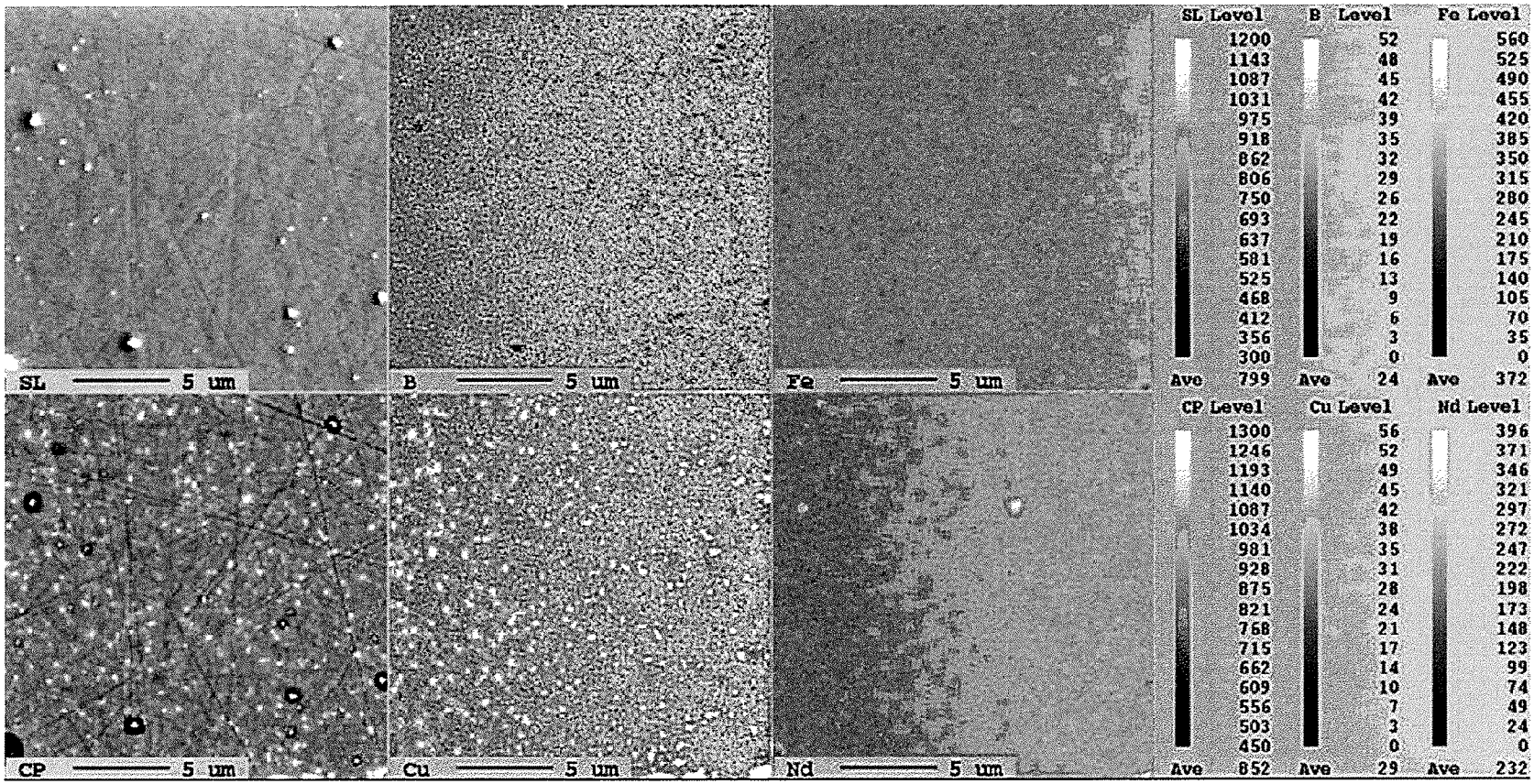
FIG. 7 is a chart illustrating the secondary electron image (SL), backscattered electron image (CP), and element distributions in a region 7 in FIG. 6*a* based on an analysis by an electron probe microanalyzer (EPMA)
Figure 8:
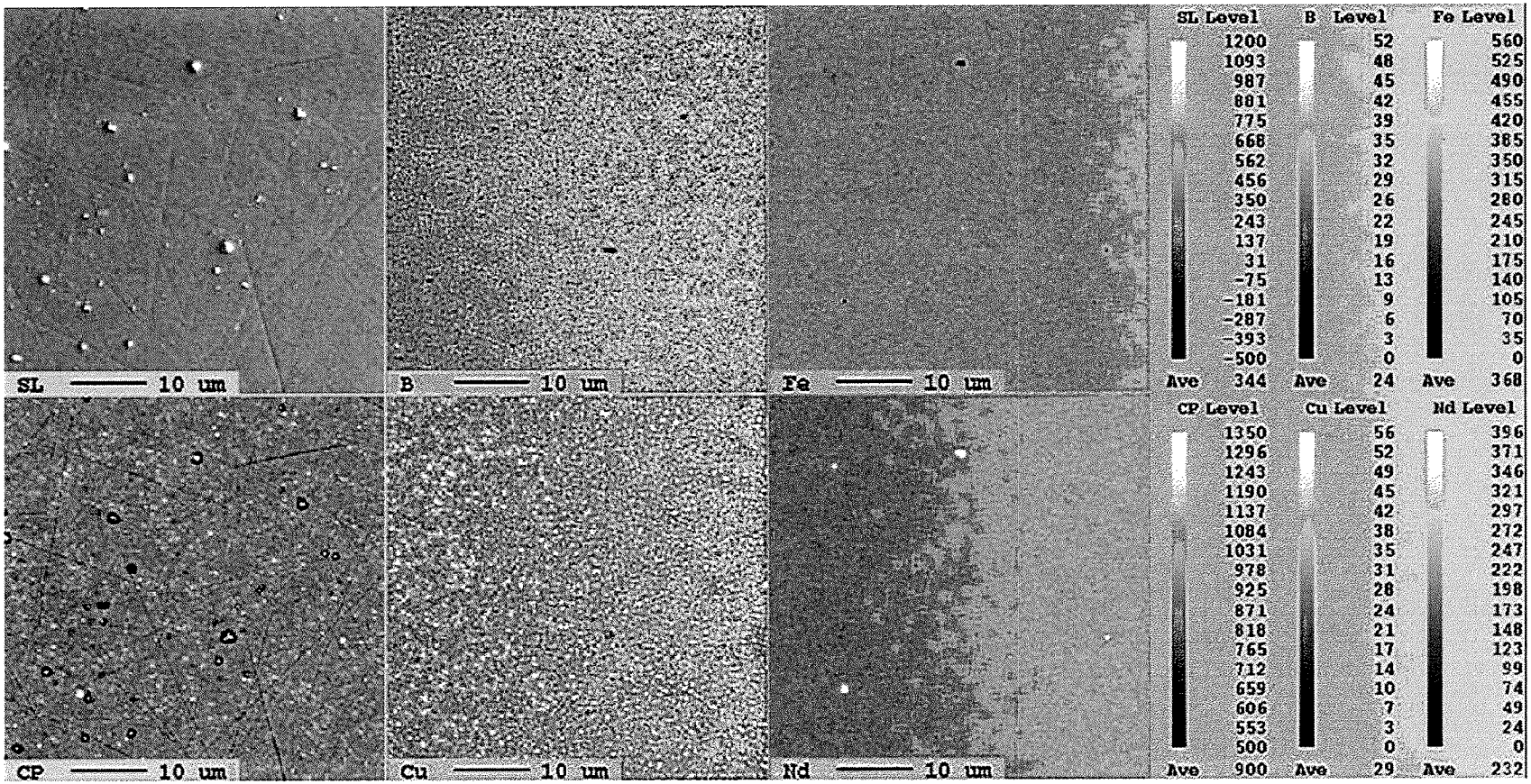
FIG. 8 is a chart illustrating the secondary electron image (SL), backscattered electron image (CP), and element distributions in a region 8 in FIG. 6*b* based on the analysis by the EPMA.
Figure 9:
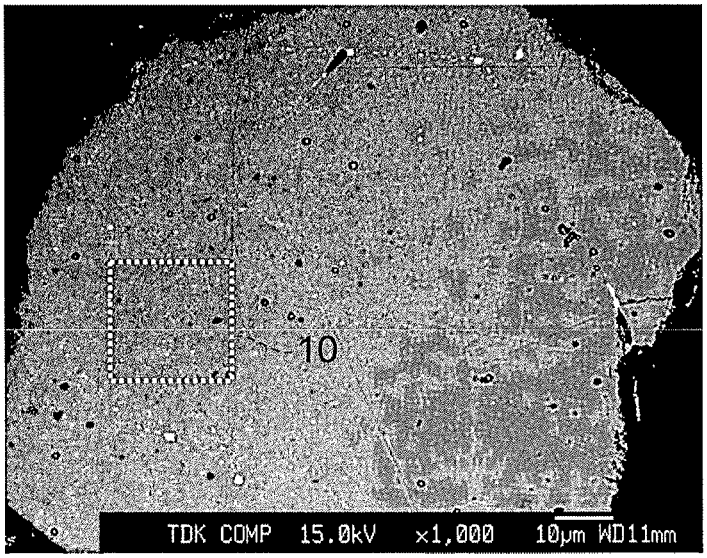
FIGS. 9*a* and 9*b* are backscattered electron images of a part of a cross section of the magnetic body of Comparative Example 5 taken by the SEM.
Figure 9:
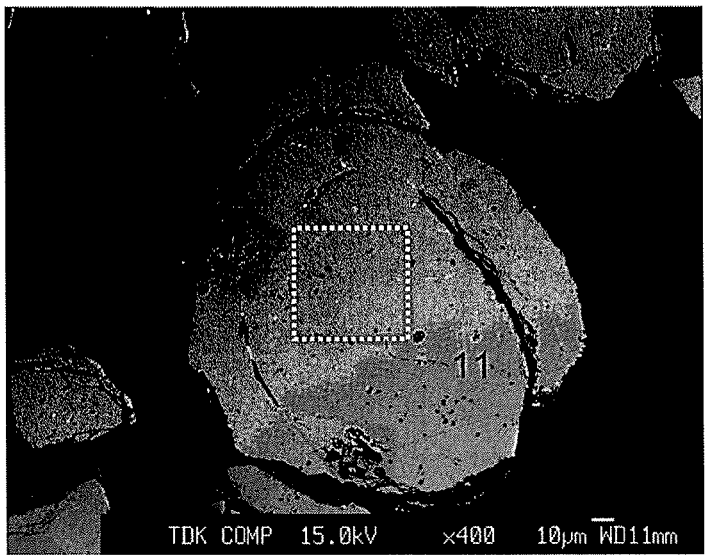
Figure 10:
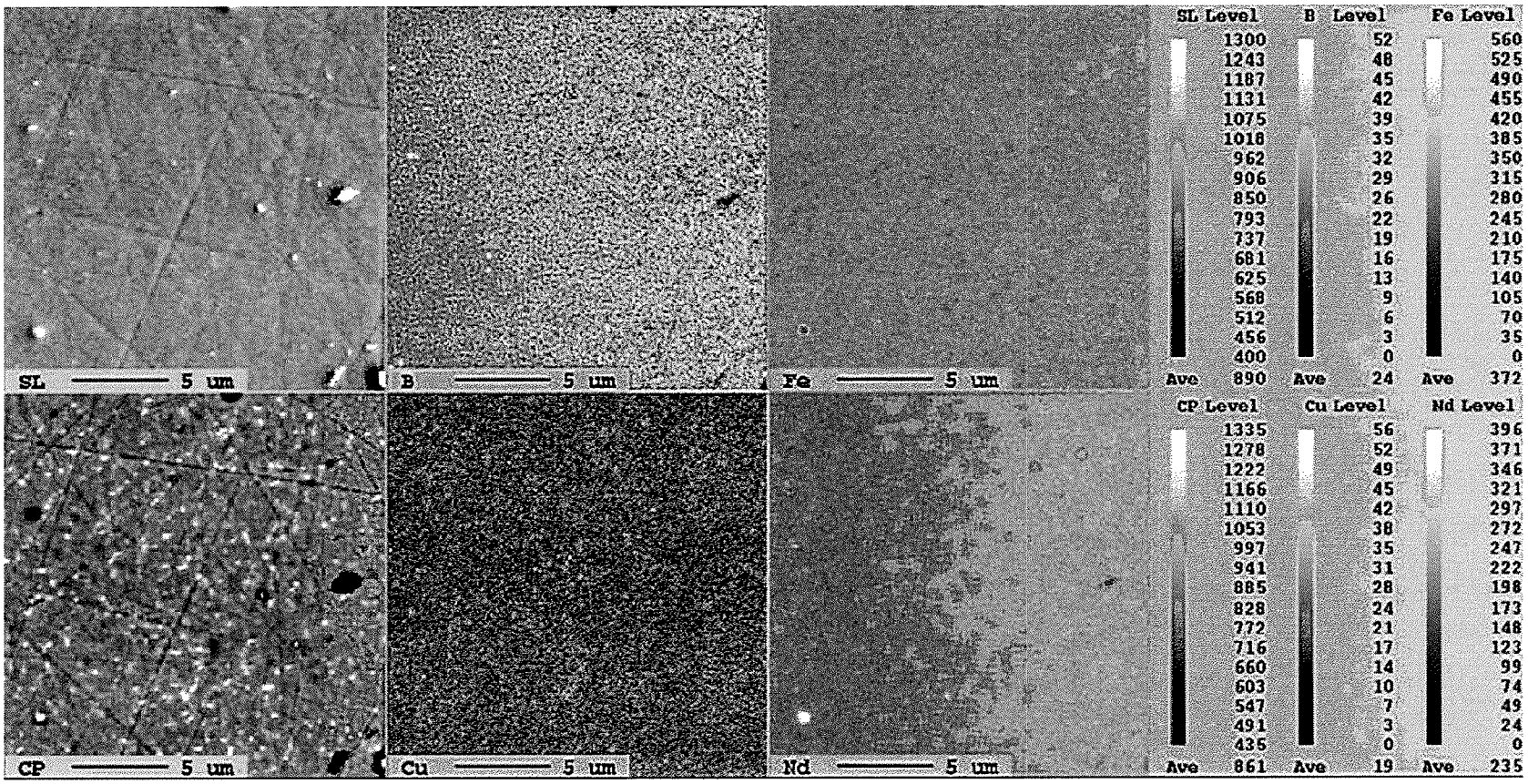
FIG. 10 is a chart illustrating the secondary electron image (SL), backscattered electron image (CP), and element distributions in a region 10 in FIG. 9*a* based on the analysis by the EPMA.
Figure 11:
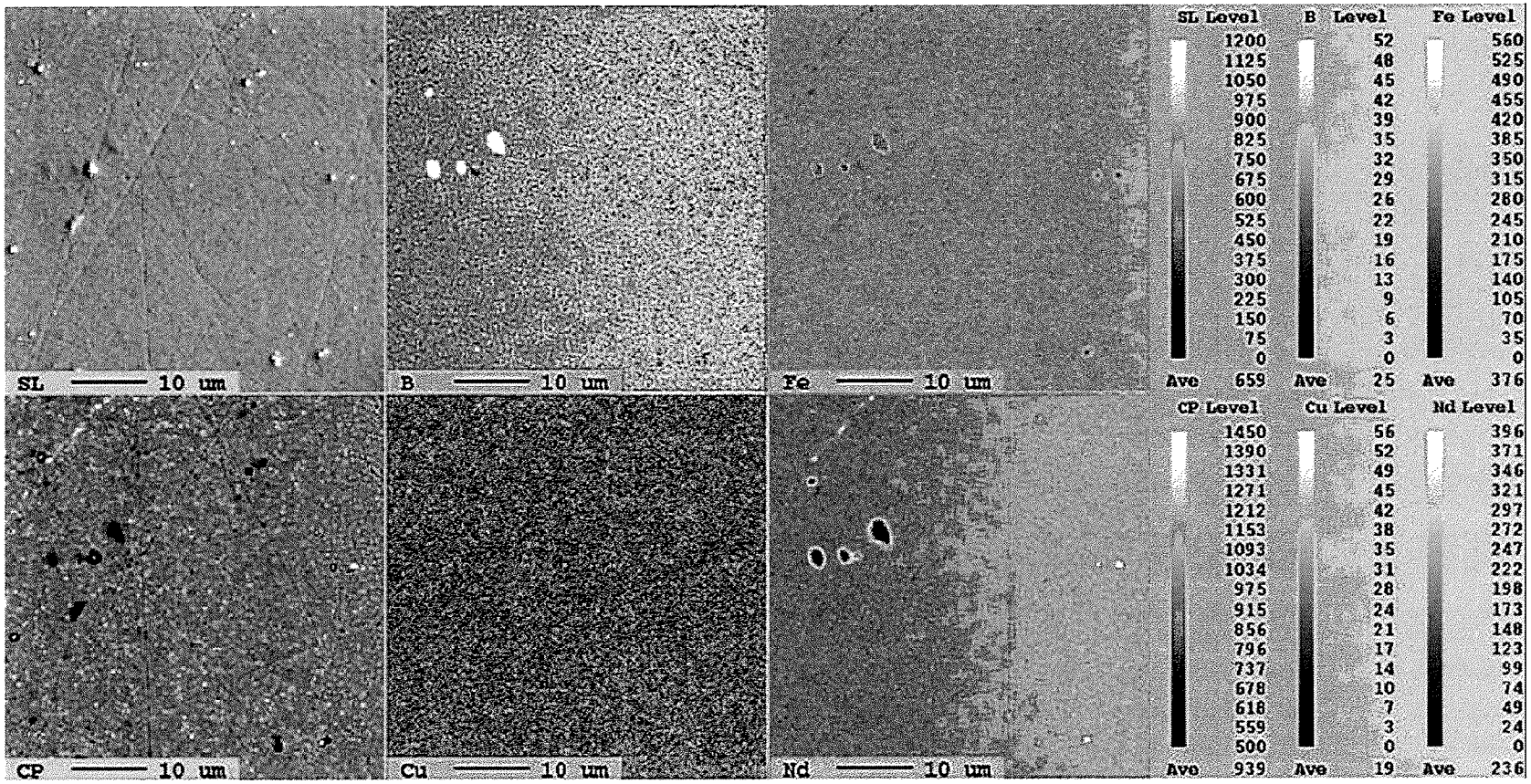
FIG. 11 is a chart illustrating the secondary electron image (SL), backscattered electron image (CP), and element distributions in a region 11 in FIG. 9*b* based on the analysis by the EPMA.

A cross section of the magnetic body obtained by Example 3 was analyzed by using an electron probe microanalyzer equipped in a scanning electron microscope (SEM-EPMA). FIGS. 6 to 8 illustrate the results of analysis of Example 3. A cross section of the magnetic body obtained by Comparative Example 5 was analyzed by using the SEM-EPMA. FIGS. 9 to 11 illustrate the results of analysis of Comparative Example 5.

FIGS. 6*a* and 6*b* are backscattered electron images of a cross section of the magnetic body of Example 3. Regions 7 and 8 in FIGS. 6*a* and 6*b* are positions (measurement regions) where data for element mapping were collected by the EPMA analysis. The region 7 has a size of 20×20 μm. The region 8 has a size of 51.2×51.2 μm. FIG. 7 is an element distribution map within the region 7 according to the EPMA analysis. FIG. 8 is an element distribution map within the region 8 according to the EPMA analysis.

FIGS. 9*a* and 9*b* are backscattered electron images of a part of a cross section of the magnetic body of Comparative Example 5. Regions 10 and 11 in FIGS. 9*a* and 9*b* are positions (measurement regions) where data for element mapping were collected by the EPMA analysis. The region 10 has a size of 20×20 μm. The region 11 has a size of 51.2×51.2 μm. FIG. 10 is an element distribution map within the region 10 according to the EPMA analysis. FIG. 11 is an element distribution map within the region 11 according to the EPMA analysis.

According to the element distribution maps based on the EPMA analysis, Cu added in Example 3 was seen to be segregated without uniformly being dispersed in the magnetic body.

STEM-EDS Analysis/Line Analysis

Figure 12:
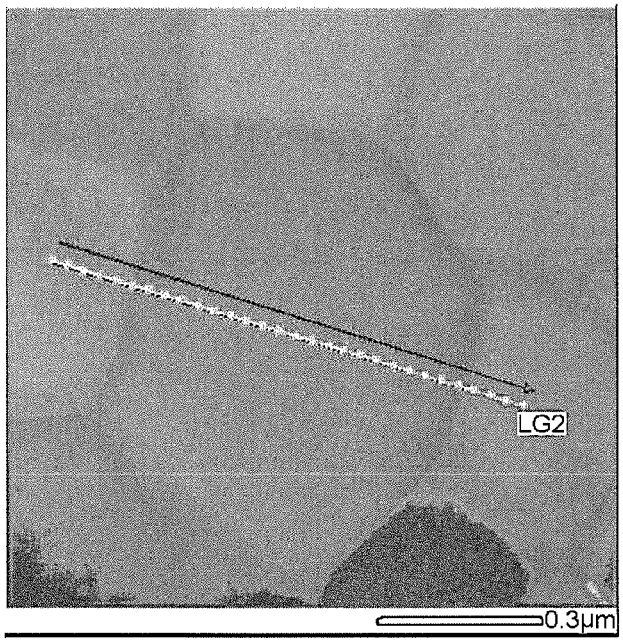
FIG. 12(*a*) is a photograph of a cross section of the magnetic body of Example 3 of the present invention taken by the STEM, while FIG. 12(*b*) is a table listing contents of elements at each analysis location on a line segment LG2 in FIG. 12(*a*)
Figure 13:
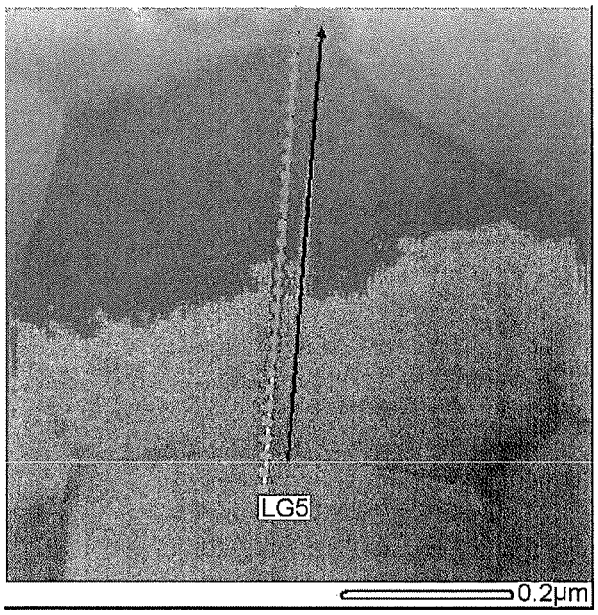
FIG. 13(*a*) is a photograph of a cross section of the magnetic body of Comparative Example 5 taken by the STEM, while FIG. 13(*b*) is a table listing contents of elements at each analysis location on a line segment LG5 in FIG. 13(*a*)

Cross sections of the respective magnetic bodies obtained by Example 3 and Comparative Example 5 were analyzed by energy dispersive spectroscopy equipped in a scanning transmission electron microscope (STEM-EDS). FIGS. 12(*a*) and 12(*b*) illustrate the results of Example 3. FIGS. 13(*a*) and 13(*b*) illustrate the results of Comparative Example 5. LG20000 to LG20029 in FIG. 12(*b*) are locations (analysis locations) where contents of elements were measured by the STEM-EDS and correspond to points arranged at substantially equally-spaced intervals on a line segment LG2 in FIG. 12(*a*). LG50000 to LG50029 in FIG. 13(*b*) are locations (analysis locations) where contents of elements were measured by the STEM-EDS and correspond to points arranged at substantially equally-spaced intervals on a line segment LG5 in FIG. 13(*a*). The element contents at each of the analysis locations illustrated in FIGS. 12(*b*) and 13(*b*) are expressed in the unit of atom %. The arrows in FIGS. 12(*a*) and 13(*a*) indicate respective directions in which the line analysis was performed. LG20000 in FIG. 12(*b*) is the start point of the line analysis and located on the origin side of the arrow in FIG. 12(*a*). LG20029 in FIG. 12(*b*) is the end point of the line analysis and located on the leading end side of the arrow in FIG. 12(*a*). LG50000 in FIG. 13(*b*) is the start point of the line analysis and located on the origin side of the arrow in FIG. 13(*a*). LG50029 in FIG. 13(*b*) is the end point of the line analysis and located on the leading end side of the arrow in FIG. 13(*a*). The lengths (unit: μm) attached to LG20000 to LG20029 in FIG. 12(*b*) are respective distances from LG20000 to the analysis locations. The lengths (unit: μm) attached to LG50000 to LG50029 in FIG. 13(*b*) are respective distances from LG50000 to the analysis locations.

As illustrated in FIG. 12(*b*), in the magnetic body of Example 3 made of the heat-treated Cu-doped material mixture, the Cu content in the main-phase particles was seen to be on a par with that in grain boundaries. On the other hand, as illustrated in FIG. 13(*b*), it was seen in Comparative Example 5 whose material mixture was doped with no Cu that, even when the material mixture was heat-treated, Cu existed by a relatively large amount in grain boundaries but hardly in the main-phase particles.

STEM-EDS Analysis/Point Analysis

Figure 14:
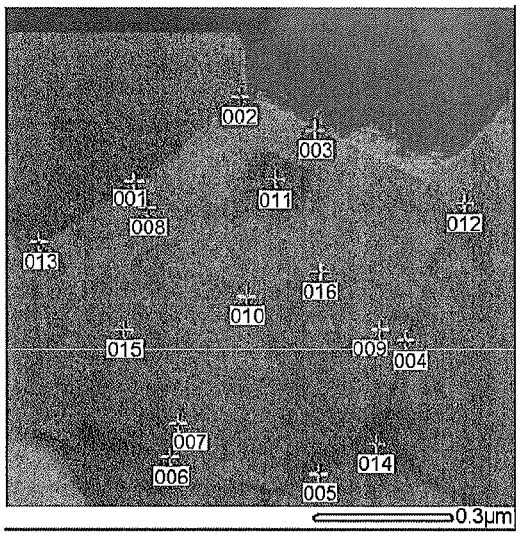
FIGS. 14(*a*) and 14(*b*) are photographs of cross sections of the magnetic body of Example 3 of the present invention taken by the STEM, while FIG. 14(*c*) is a table listing contents of elements at each analysis location in FIGS. 14(*a*) and 14(*b*)
Figure 14:
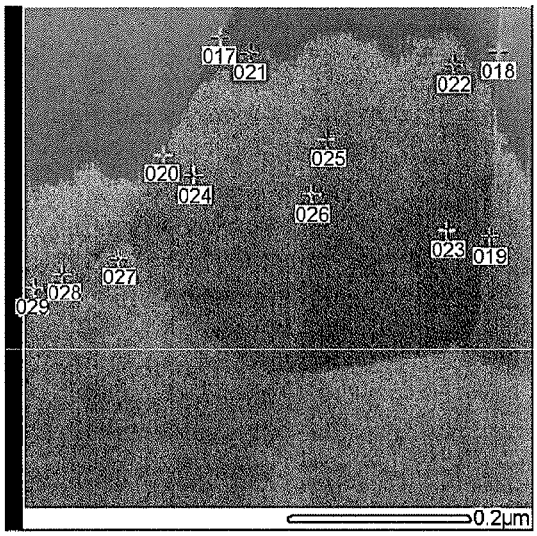
Figure 15:
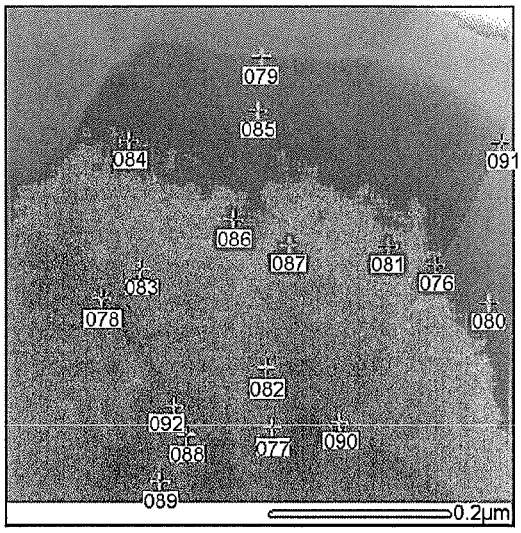
FIGS. 15(*a*) and 15(*b*) are photographs of cross sections of the magnetic body of Comparative Example 5 taken by the STEM, while FIG. 15(*c*) is a table listing contents of elements at each analysis location in FIGS. 15(*a*) and 15(*b*).
Figure 15:
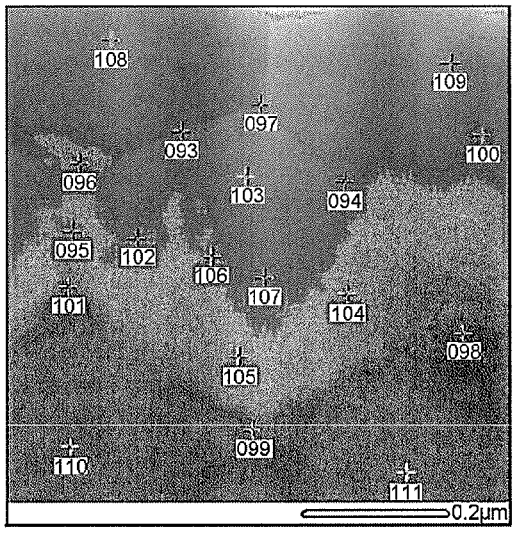

Cross sections of the respective magnetic bodies obtained by Example 3 and Comparative Example 5 were analyzed by the STEM-EDS. FIGS. 14(*a*), 14(*b*), and 14(*c*) illustrate the results of analysis of Example 3. FIGS. 15(*a*), 15(*b*), and 15(*c*) illustrate the results of analysis of Comparative Example 5. Contents of elements at each of measurement locations "+" illustrated in FIGS. 14(*a*) and 14(*b*) were measured by the STEM-EDS. FIG. 14(*c*) lists the element contents at each of the measurement locations in FIGS. 14(*a*) and 14(*b*). Contents of elements at each of measurement locations "+" illustrated in FIGS. 15(*a*) and 15(*b*) were measured by the STEM-EDS. FIG. 15(*c*) lists the element contents at each of the measurement locations in FIGS. 15(*a*) and 15(*b*). By "grain boundary" in FIGS. 14(*c*) and 15(*c*) is meant a boundary region between two crystal particles (main-phase particles) constituting the magnetic body. By "grain boundary triple junction" is meant a phase surrounded by three or more crystal particles constituting the magnetic body.

According to the results of point analysis listed in FIG. 14(*c*), average values of element contents were determined in the grain boundaries, main-phase particles, and grain boundary triple junctions in the magnetic body of Example 3. Table 3 lists the results. According to the results of point analysis listed in FIG. 15(*c*), average values of element contents were determined in the grain boundaries, main-phase particles, and grain boundary triple junctions in the magnetic body of Comparative Example 5. Table 4 lists the results.

TABLE 3

| | Content (atom %) | | | | | | | |
|---|---|---|---|---|---|---|---|---|
| Example 3 | O | Al | Fe | Co | Cu | Ga | Nb | Nd |
| Grain boundary | 3.0 | 0.2 | 78.4 | 5.2 | 0.8 | 0.8 | 0.0 | 11.7 |
| Main-phase particle | 2.6 | 0.1 | 80.6 | 4.9 | 0.5 | 0.6 | 0.0 | 10.7 |
| Grain boundary triple junction | 4.6 | 0.2 | 45.6 | 4.6 | 14.3 | 2.4 | 0.0 | 28.3 |

TABLE 4

| | Content (atom %) | | | | | | | |
|---|---|---|---|---|---|---|---|---|
| Comparative Example5 | O | Al | Fe | Co | Cu | Ga | Nb | Nd |
| Grain boundary | 7.8 | 0.1 | 74.0 | 4.7 | 0.2 | 0.8 | 0.0 | 12.4 |
| Main-phase particle | 7.3 | 0.2 | 76.0 | 4.7 | 0.0 | 0.5 | 0.0 | 11.4 |
| Grain boundary triple junction | 10.2 | 0.2 | 57.5 | 6.8 | 0.6 | 2.0 | 0.0 | 22.7 |

When Tables 3 and 4 were compared with each other, the Cu content in the main-phase particles was seen to be higher in Example 3 than in Comparative Example 5. In Example 3, Cu was seen to be segregated at the grain boundary triple junctions. As with Example 3 and Comparative Example 5, the other examples and comparative examples were subjected to the point analysis by the STEM-EDS. Table 5 lists the Cu contents in the main-phase particles of the examples and comparative examples determined from the results of point analysis. Table 6 shows the relationship between the residual magnetic flux density listed in Table 5 and the Cu amount and heat treatment temperature. Table 7 shows the relationship between the coercive force listed in Table 5 and the Cu amount and heat treatment temperature. Table 8 shows the relationship between the mf/HcJ listed in Table 5 and the Cu amount and heat treatment temperature. Table 9 shows the relationship between the Cu content in the main-phase particles listed in Table 5 and the Cu amount and heat treatment temperature. In Tables 6 to 9, the values marked with "*" are those of the examples.

TABLE 5

| | | Heat treatment | Residual magnetic flux density | Coercive force | External magnetic field mf | | Cu content in main-phase |
|---|---|---|---|---|---|---|---|
| | Cu amount mass % | temperature ° C. | Br kG | HcJ kOe | Absolute value kOe | mf/HcJ — | particles atom % |
| Example 1 | 1.00 | 700 | 12.25 | 4.33 | 4.76 | 1.099 | 0.6 |
| Example 2 | 1.00 | 800 | 12.53 | 3.82 | 3.98 | 1.042 | 0.5 |
| Example 3 | 1.00 | 900 | 12.44 | 4.10 | 4.30 | 1.049 | 0.5 |
| Example 4 | 1.25 | 900 | 11.31 | 2.45 | 2.54 | 1.035 | 0.5 |
| Example 5 | 1.00 | 950 | 12.50 | 3.78 | 4.11 | 1.088 | 0.6 |
| Example 6 | 1.25 | 950 | 11.32 | 2.25 | 2.47 | 1.097 | 0.6 |
| Comparative Example 1 | 0.00 | 700 | 13.10 | 14.11 | 14.91 | 1.057 | 0.1 |

TABLE 5-continued

| | Cu amount mass % | Heat treatment temperature ° C. | Residual magnetic flux density Br kG | Coercive force HcJ kOe | External magnetic field mf Absolute value kOe | External magnetic field mf mf/HcJ — | Cu content in main-phase particles atom % |
|---|---|---|---|---|---|---|---|
| Comparative Example 2 | 1.25 | 700 | 9.26 | 1.31 | 1.68 | 1.285 | 0.7 |
| Comparative Example 3 | 0.00 | 800 | 12.91 | 13.50 | 13.51 | 1.001 | 0.0 |
| Comparative Example 4 | 1.25 | 800 | 7.27 | 0.79 | 0.96 | 1.217 | 0.8 |
| Comparative Example 5 | 0.00 | 900 | 12.75 | 13.33 | 13.71 | 1.029 | 0.0 |
| Comparative Example 6 | 1.50 | 900 | 9.61 | 1.35 | 1.58 | 1.170 | 0.6 |
| Comparative Example 7 | 0.00 | 950 | 12.85 | 2.80 | 6.27 | 2.243 | 0.0 |
| Comparative Example 8 | 1.50 | 950 | 10.00 | 1.41 | 1.74 | 1.237 | 0.7 |

TABLE 6

| (Br) | | Heat treatment temperature 700° C. | 800° C. | 900° C. | 950° C. |
|---|---|---|---|---|---|
| Cu amount | 0 mass % | 13.10 kG | 12.91 kG | 12.75 kG | 12.85 kG |
| | 1 mass % | * 12.25 kG | * 12.53 kG | * 12.44 kG | * 12.50 kG |
| | 1.25 mass % | 9.26 kG | 7.27 kG | * 11.31 kG | * 11.32 kG |
| | 1.5 mass % | — | — | 9.61 kG | 10.00 kG |

TABLE 7

| (HcJ) | | Heat treatment temperature 700° C. | 800° C. | 900° C. | 950° C. |
|---|---|---|---|---|---|
| Cu amount | 0 mass % | 14.11 kOe | 13.50 kOe | 13.33 kOe | 2.80 kOe |
| | 1 mass % | * 4.33 kOe | * 3.82 kOe | * 4.10 kOe | * 3.78 kOe |
| | 1.25 mass % | 1.31 kOe | 0.79 kOe | * 2.45 kOe | * 2.25 kOe |
| | 1.5 mass % | — | — | 1.35 kOe | 1.41 kOe |

TABLE 8

| (mf/HcJ) | | Heat treatment temperature 700° C. | 800° C. | 900° C. | 950° C. |
|---|---|---|---|---|---|
| Cu amount | 0 mass % | 1.057 | 1.001 | 1.029 | 2.243 |
| | 1 mass % | * 1.099 | * 1.042 | * 1.049 | * 1.088 |
| | 1.25 mass % | 1.285 | 1.217 | * 1.035 | * 1.097 |
| | 1.5 mass % | — | — | 1.170 | 1.237 |

TABLE 9

| (Cu content in main-phase particles) | | Heat treatment temperature 700° C. | 800° C. | 900° C. | 950° C. |
|---|---|---|---|---|---|
| Cu amount | 0 mass % | 0.1 atom % | 0.0 atom % | 0.0 atom % | 0.0 atom % |
| | 1 mass % | * 0.6 atom % | * 0.5 atom % | * 0.5 atom % | * 0.6 atom % |
| | 1.25 mass % | 0.7 atom % | 0.8 atom % | * 0.5 atom % | * 0.6 atom % |
| | 1.5 mass % | — | — | 0.6 atom % | 0.7 atom % |

Examples 1 to 3 and 5 at the Cu amount of 1 mass % and the heat treatment temperature of 700° C. to 950° C. were seen to diffuse Cu uniformly in the Nd—Fe—B-based main-phase particles and have low coercive force. Examples 4 and 6 at the Cu amount of 1.25 mass % and the heat treatment temperature of 900° C. to 950° C. were also seen to diffuse Cu uniformly in the Nd—Fe—B-based main-phase particles and have low coercive force. The low coercive force in Examples 1 to 6 is assumed to have resulted from the fact that the anisotropic magnetic field HA of $Nd_2Fe_{14}B$ in the main-phase particles decreased.

Comparative Examples 1, 3, and 5 at the Cu amount of 0 and the heat treatment temperature of 700° C. to 900° C. exhibited no magnetic changes associated with variations in the heat treatment temperature. That is, no remarkable differences were seen between the magnetic bodies of Comparative Examples 1, 3, and 5 and their material mixtures. Comparative Example 7 at the Cu amount of 0 and the heat treatment temperature of 950° C. exhibited grain growth and an increase in mf/HcJ. The grain growth in Comparative Example 7 seems to have resulted from the fact that the heat treatment temperature was too high. The increase in mf/HcJ in Comparative Example 7 seems to have resulted from the fact that the magnetization mechanism of the magnetic body became the nucleation type.

Comparative Examples 2 and 4 at the Cu amount of 1.25 mass % and the heat treatment temperature of 700° C. to 800°

C. seem to fail to diffuse Cu uniformly in the Nd—Fe—B-based main-phase particles because of their low heat treatment temperature, thereby yielding a part with high Cu concentration. It is inferred that a Cu-rare-earth compound (e.g., $NdCu_5$) was formed in the part having the high Cu concentration, whereby Nd—Fe—B was partly deprived of its Nd. The residual magnetic flux density Br seems to have decreased in Comparative Examples 2 and 4 as a result.

In Comparative Examples 6 and 8 at the Cu amount of 1.5 mass % and the heat treatment temperature of 900° C. to 950° C., the Cu amount was too high. It seems that, as a result, an excess of Cu existed on the outside of the main-phase particles even when Cu diffused uniformly in the Nd—Fe—B-based main-phase particles. It is inferred that the excess of Cu formed a Cu-rare-earth compound (e.g., $NdCu_5$), whereby Nd—Fe—B was partly deprived of its Nd. Comparative Examples 6 and 8 seem to have lowered the residual magnetic field Br as a result.

INDUSTRIAL APPLICABILITY

The present invention can reversibly change its magnetic force with a small external magnetic field while having a high residual magnetic flux density and thus is suitable as a variable-magnetic-force magnet for variable-magnetic-flux motors equipped in home appliances, hybrid cars, electric trains, elevators, and the like.

The invention claimed is:

1. A magnetic body comprising:

a residual magnetic flux density Br of at least 11 kG; and a coercive force HcJ of 5 kOe or less;

wherein an external magnetic field required for the residual magnetic flux density Br to become 0 is 1.049 HcJ or less.

2. A magnetic body according to claim 1, further comprising a rare-earth element R, a transition metal element T, and boron B.

3. A magnetic body comprising:

a residual magnetic flux density Br of at least 11 kG; and a coercive force HcJ of 5 kOe or less;

wherein an external magnetic field required for the residual magnetic flux density Br to become 0 is 1.10 HcJ or less, and wherein said magnetic body includes crystal particles having a rare-earth element R, a transition metal element T, and boron B, and the content of Cu in said particles is 0.5 to 0.6 atom % to the total atoms present within said crystal particles.

4. A magnetic body according to claim 1, wherein the content of Cu in said magnetic body to the total mass of said magnetic body is 1.0 to 1.25 mass %.

5. A magnetic body according to claim 3, wherein the content of Cu in said magnetic body to the total mass of said magnetic body is 1.0 to 1.25 mass %.

6. A magnetic body according to any one of claims 1 to 5, having a crystal particle size of 1 μm or less.

* * * * *